United States Patent [19]

Chen

[11] Patent Number: 4,566,187

[45] Date of Patent: Jan. 28, 1986

[54] METHOD FOR FIXING ELECTRIC CORD AND AN ELECTRICAL CONNECTOR

[76] Inventor: Kun S. Chen, No. 3, Alley 3, Lane 418, Hsin-Hsing Rd., Tainan City, Taiwan

[21] Appl. No.: 608,650

[22] Filed: May 9, 1984

[51] Int. Cl.[4] ..... H01R 43/00; H01R 13/62; H01R 33/05

[52] U.S. Cl. ..... 29/857; 339/74 R; 339/196 R

[58] Field of Search ..... 29/857; 339/195 R, 195 A, 339/103 R, 195 M, 195 S, 196 R, 196 A, 196 M, 105, 74 R

[56] References Cited

U.S. PATENT DOCUMENTS

| | | | |
|---|---|---|---|
| 2,673,968 | 3/1954 | Smith | 339/105 X |
| 2,788,502 | 4/1957 | Schelke et al. | 339/103 R X |
| 2,810,894 | 10/1957 | Kerr | 339/99 R |
| 4,360,242 | 11/1982 | Poliak et al. | 339/99 R |

FOREIGN PATENT DOCUMENTS

| | | | |
|---|---|---|---|
| 1166319 | 3/1964 | Fed. Rep. of Germany | 339/105 |

*Primary Examiner*—Howard N. Goldberg
*Assistant Examiner*—Carl J. Arbes
*Attorney, Agent, or Firm*—Lowe King Price & Becker

[57] ABSTRACT

An apparatus for fixing electric cord utilizing an insulator-fixing plate to fix the rubber covering of a wire and a bare wire-fixing plate to fix the bare portion of the wire, thereby firmly fixing the wire and facilitating the mounting and dismounting of wire.

3 Claims, 11 Drawing Figures

METHOD FOR FIXING ELECTRIC CORD AND AN ELECTRICAL CONNECTOR

BACKGROUND OF THE INVENTION

A plug is an electrical deivce to be fitted in a receptacle to close the circuit. When in use, both the plug and the receptacle must be fitted with a wire. However, it is cumbersome to attach a cord to a commonly used plug or receptacle. Further, the cord attached thereto is easily pulled out.

It is, therefore, an object of the present invention to provide an apparatus which may obviate the abovementioned drawbacks.

SUMMARY

It is the primary object of the present invention to provide an apparatus with which an electric cord may be rapidly fitted.

It is another object of the present invention to provide an apparatus from which the electric cord attached thereto may be quickly disconnected.

It is still another object of the present invention to provide an apparatus to which an electric cord may be firmly attached.

It is still another object of the present invention to provide an apparatus which may be applied to a plug.

It is still another object of the present invention to provide an apparatus which may be applied to a receptacle.

It is still another object of the present invention to provide an apparatus for fixing electric cord which is easy to operate.

It is still another object of the present invention to provide an apparatus for fixing electric cord which is simple in structure.

Other objects and merits of the present invention will become apparent from reading the following detailed description of the preferred embodiments.

DETAILED DESCRIPTION OF THE PREFERRED EMBODIMENTS

Figure 1:
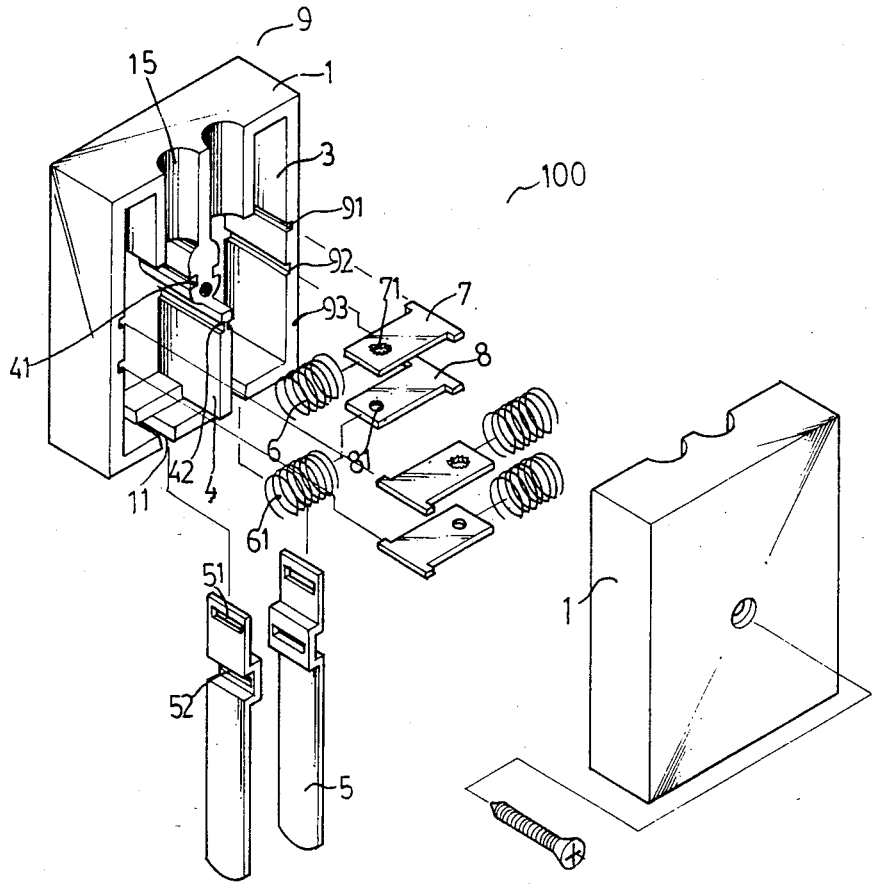
FIG. 1 is a fragmentary perspective view of an apparatus for fixing electric cord according to a preferred embodiment of the present invention.
Figure 2:
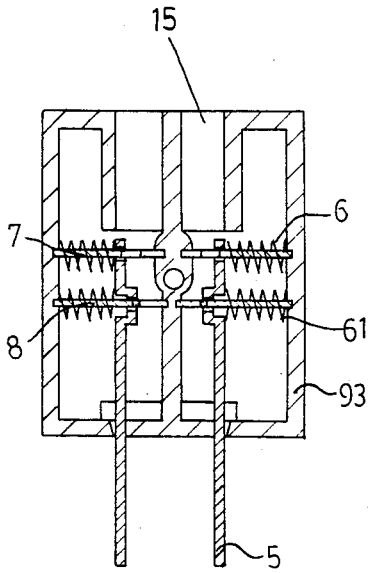
FIG. 2 is a cross-sectional view of the apparatus of FIG. 1.

Referring now to FIGS. 1–4, there is shown an apparatus for fixing electric cord according to a preferred embodiment of the present invention. The apparatus is designed as a plug (100). The plug (100) comprises a casing (9) having two halves (1) which are joined together by screws or any other suitable fixing means. The interior of the casing (9) is divided into two chambers (3) by a partition (4). The casing (9) is provided on its top with two openings (15) each communicating with a corresponding chamber (3). On the bottom of the casing (9) there are two slots (11) respectively communicating with the two chambers (3). A prong (5) is mounted into each chamber (3), with its lower part extending through the bottom of the casing (9). Each prong (5) comes with two solts (51) and (52) at its upper part. An insulator-fixing plate (7) surrounded by a spring (6) and having a toothed hole (71) is inserted through the slot (51) of each prong (5) and embedded at one end in a groove (41) of the partition (4) and at the other end in a groove (91) of side wall (93) of the casing (9). The spring (6) is disposed between the side wall (93) and the prong (5). The toothed hole (71) is designed so that the commonly used wire may be passed through. Below each insulator-fixing plate (7) there is a bare wire-fixing plate (8) which is inserted through the slot (52) of the prong (5) and embedded at one end in groove (42) of the partition (4) and a groove (92) of the side wall (93) of the casing (9). The bare wire-fixing plate (8) is encased in a spring (61) and is possessed of an aperture (81). The spring (61) is arranged between the side wall (93) and the prong (5). The aperture (81) of the bare wire-fixing plate (8) is designed so that only a commonly used bare wire can extend through. Since each prong (5) is compressed by the springs (6) and (61), the prong (5) may be kept in place in normal state. The toothed hole (71) of the insulator-fixing plate (7) and the aperture (81) of the bare wire-fixing plate (8) are arranged to be in alignment with the center line of the hole (15) of the casing (9) and are partially shielded by the prong (5) in normal state.

Figure 3:
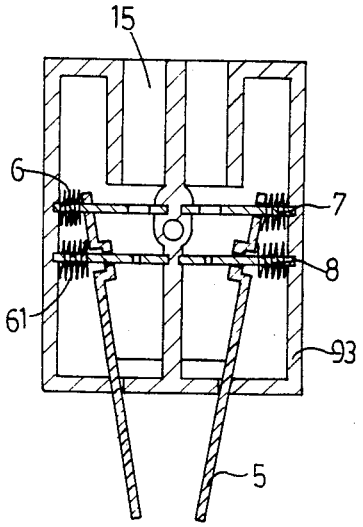
FIG. 3 is a cross-sectional view of the apparatus with its prongs pressed inwards.
Figure 4:
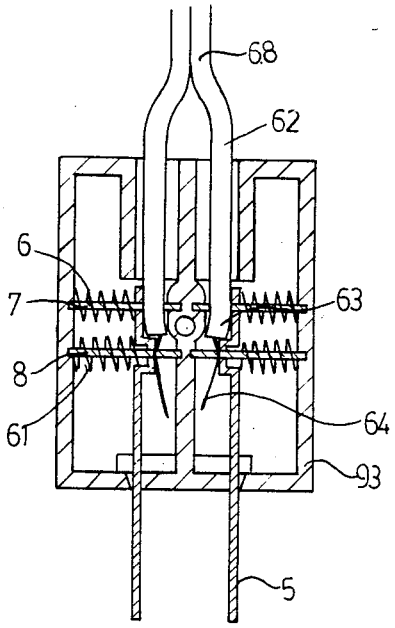
FIG. 4 is a cross-sectional view of the apparatus with a cord connected thereto.
Figure 5:
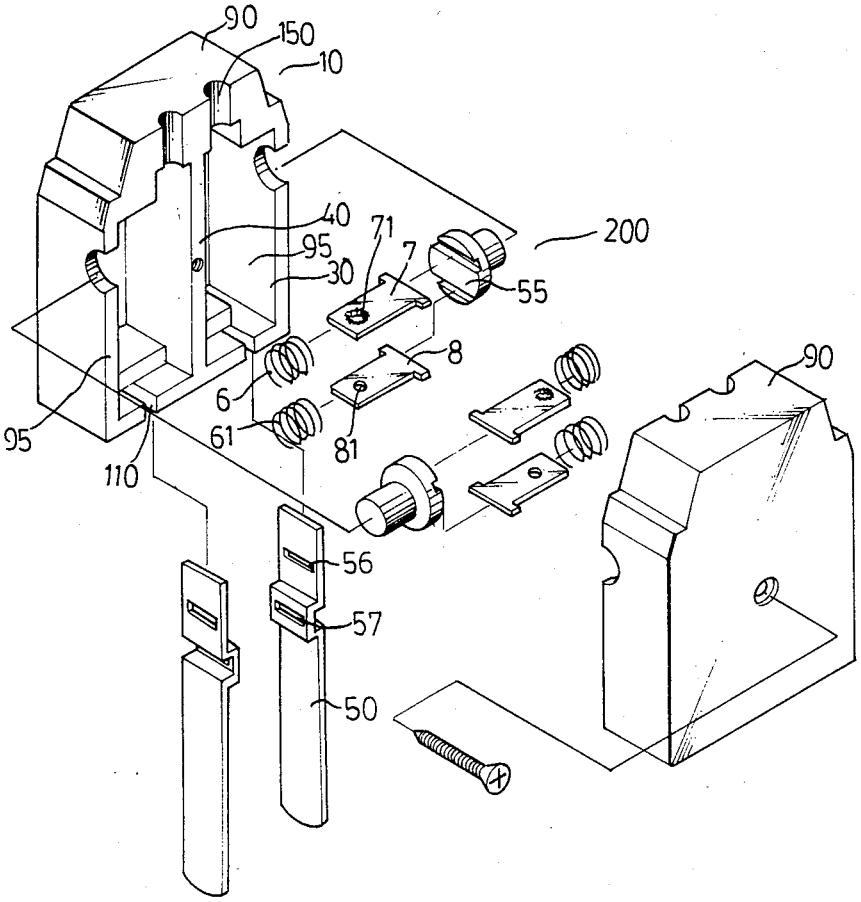
FIG. 5 is a fragmentary perspective view of an apparatus for fixing electric cord according to a second preferred embodiment of the present invention.
Figure 6:
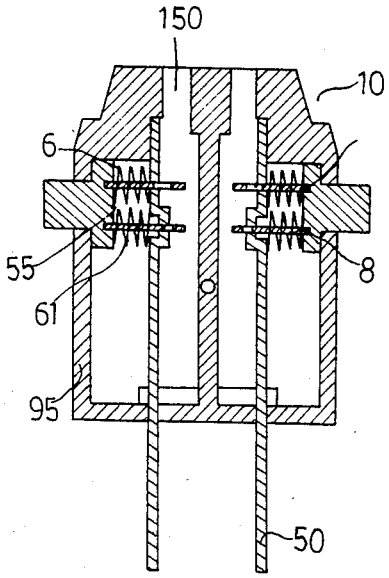
FIG. 6 is a cross-sectional view of the apparatus of FIG. 5.

In use, first press the prongs (5) towards each other (as shown in FIG. 3). Then each wire (62) of a cord (68) is inserted into each hole (15) of the casing (9), with its rubber covering (63) and bare portion (64) extending through the toothed hole (71) of the insulator-fixing plate (7) and the aperture (81) of the bare wire-fixing plate (8) respectively. Then, release the two prongs (5), thereby clamping tightly the rubber covering (63) and the bare portion (64) of the wire (62). If required to detach the wires (62) from the plug (100), simply press the two prongs (5) inwards to release the wires (62) and then pull them out.

FIGS. 5, 6, 7 and 8 show an apparatus for fixing electric cord according to a second preferred embodiment of the prevent invention. The apparatus is also designed as a plug (200). Parts corresponding to those of the plug (100) are identically numbered. The insulator-fixing plate (7), the bare wire-fixing plate (8), and the springs (6) and (61) are the same as shown in FIGS. 1–4, and so will not be detailedly described hereinafter. As may be seen particularly in FIGS. 5 and 6, the plug (200) according to the second preferred embodiment of the present invention comprises a casing (10) including the halves (90) screwed or otherwise joined together. The interior of the casing (90) is divided into two chambers (30) by a partition (40). The casing (90) is provided at its top with two holes (150) each communicating with a corresponding chamber (30). At the bottom of the casing (10) there are two slots (110) in communication with the two chambers (30) respectively. Inside each of the chambers (30) is fixedly mounted a prong (50) the lower part of which extends out of the slot (11) of the casing (90). Each of the prong (50) is formed with two slots (56) and (57) at its upper part. An insulator-fixing plate (7) surrounded by a spring (6) is inserted through the slot (56) of each prong (5) and embedded at one end in a push button (55) movably mounted in the casing (90). The spring (6) is disposed between side wall (95) and the push button (55). Below each insulator-fixing plate (7) is a bare wire-fixing plate (8) which is inserted through the slot (57) of each prong (50) and embedded at one end in the push button (55). As illustrated, the bare wire-fixing plate (8) is encased in a spring (61) which is disposed between the side wall (95) and the push button (55). Accordingly, the insulator-fixing plate (7) and the bare wire-fixing plate (8) will move towards the partition (40) when the push buttons (55) are depressed. The toothed hole (71) of the insulator-fixing plate (7) and aperture (81) of the bare wire-fixing plate (8) are designed so that they will be in alignment with the center line of the hole (150) only when the push button (55) is depressed.

Figure 7:
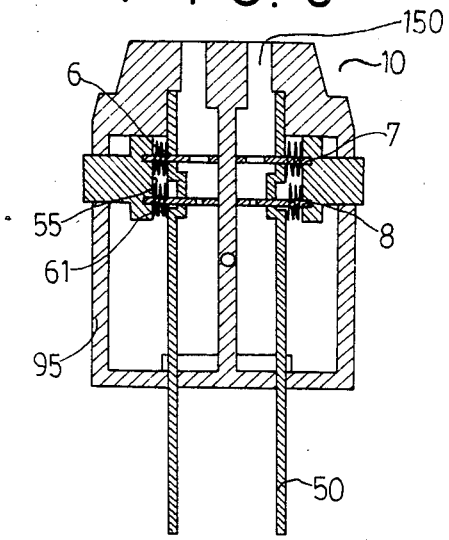
FIG. 7 is a cross-sectional view of the apparatus of FIG. 5, with its two push buttons pressed into the casing.
Figure 8:
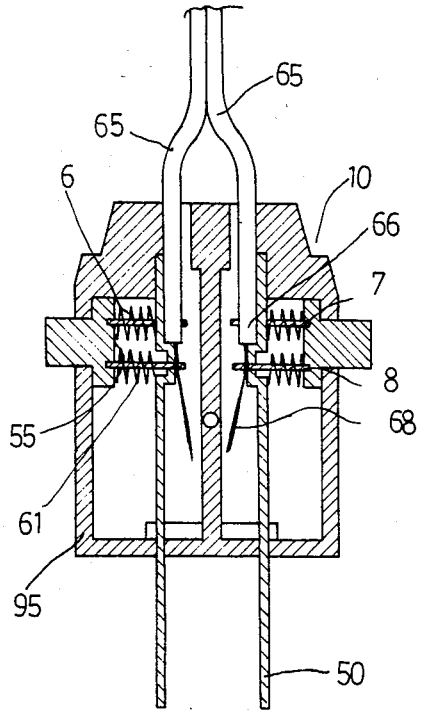
FIG. 8 is a cross-sectional view of the apparatus with a cord connected thereto.

When in use, first press the push buttons (55) inward (as shown in FIG. 7). Then, insert the wires (65) of a cord into the two holes (150) respectively, with bare portion (68) extending through aperature (81) of the bare wire-fixing plates (8) and the rubber covering (66) of the wires (61) extending through the toothed holes (71) of the insulator-fixing plate (7) (as shown in FIG. 8). Then, release the push buttons (55) thereby causing the insulator-fixing plates (7) and the bare wire-fixing plates (8) to clamp tightly the rubber covering (66) and the bare portion (68) respectively.

To disconnect the cord (65) from the plug (200), simply press the push buttons (55) inward to release the wires of the cord (65) and then pull them out.

Figure 9:
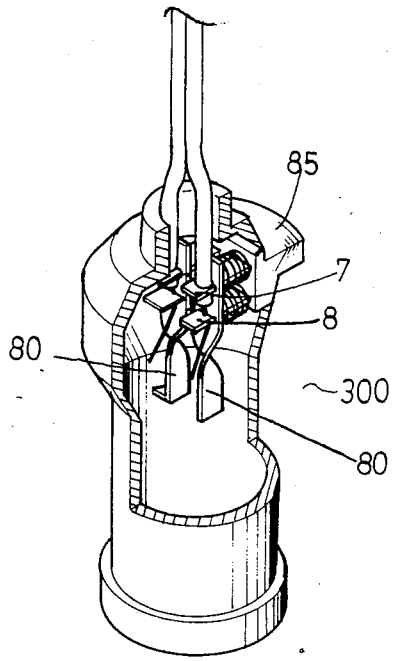
FIG. 9 is a cutaway view of an apparatus for fixing electric cord according to a third preferred embodiment of the present invention.

Turning to FIG. 9, there is shown a third preferred embodiment of the present invention. As shown, the preferred embodiment is a socket (300) for connecting with a bulb or the like. The socket (300) comprises two prongs (80) each of which is engaged with an insulator-fixing plate (7) and a bare wire-fixing plate (8) which are embedded at the other end in a push button (85). Consequently, as the push button (85) is pressed, the wires of a cord may be engaged with the insulator-fixing plates (7) and the bare wire-fixing plates (8) at the same time.

Figure 10:
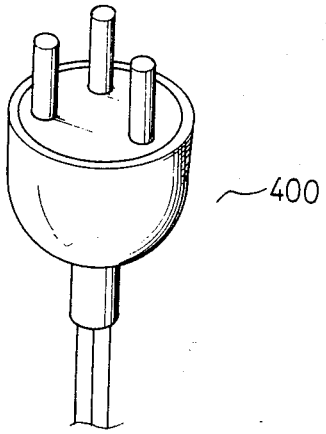
FIG. 10 is a perspective view of a fourth preferred embodiment of the present invention.
Figure 11:
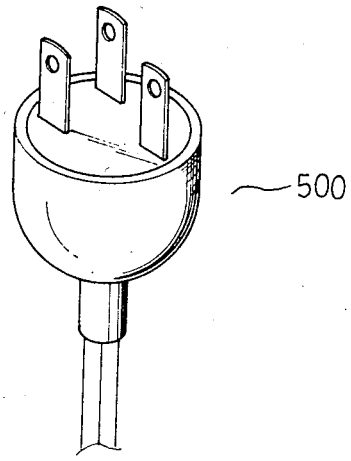
FIG. 11 is a perspective view of a fifth preferred embodiment of the present invention.

It is noted, however, that the present invention may have other modifications such as plug (400) shown in FIG. 10 and plug (500) shown in FIG. 11.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A method of fixing an electric cord to an electrical connector, comprising the steps of:

a. positioning a prong having a first slot and a second slot at an upper part thereof within a casing of said connector;

b. inserting a spring-loaded insulator-fixing plate into the first slot of said prong, said spring-loaded insulator-fixing plate having a toothed hole which allows a wire of said cord to pass through, said toothed hole being partially shielded by said prong when said prong is in a first position;

c. inserting a spring-loaded bare wire-fixing plate into the second slot of said prong, said spring-loaded bare wire-fixing plate having an aperture which only allows a bare conductive portion of said wire to pass through, said hole being partially shielded prong when said prong is in said first position;

d. moving said prong against spring bias from said first position to a second position and inserting said wire having said bare portion into the toothed hole of the insulator-fixing plate and the aperture of the bare wire-fixing plate;

whereby when said prong is moved to said second position with respect to said spring-loaded insulator-fixing plate and said spring-loaded bare wire-fixing plate, said toothed hole of said insulator-fixing plate and said hole of said bare wire-fixing plate will no longer be shielded by said prong so that said wire may pass through said toothed hole while the bare portion of the wire may pass through said hole, and when said prong is released to return to said first position a rubber covering of said wire will be clamped by the toothed hole and said prong while the bare portion of the wire will be clamped by said hole and said prong.

2. An electrical connector, comprising:

a casing the interior of which is divided into two chambers by a partition, said casing being provided on its top with two holes each communicating with one of said chambers and provided on its bottom with two passageways each communicating with one of said chambers;

two prongs respectively mounted into said two chambers in such a way that a lower part of each said prong extends out of said casing through one of said passageways, each said prong having an upper slot and a lower slot disposed at an upper part thereof;

two insulator-fixing plates respectively inserted through the upper slots of said prongs and embedded at opposite ends of each plate into said casing, each said insulator-fixing plate being surrounded by a first spring and having a toothed hole which allows a wire to pass through, said first spring forcing a corresponding one of said prongs to shield a part of said toothed hole in a first position of the prong; and two bare wire-fixing plates respectively inserted through the lower slots of said prongs and embedded at both ends in said casing, each said bare wire-fixing plate being surrounded by a second spring and having a hole which only allows the bare portion of said wire to pass through, said second spring forcing a corresponding one of said prongs to shield a part of said second hole in said first position, each said prong movable against spring bias to a second position to allow insertion of said wire through said holes in the associated insulator-fixing and wire-fixing plates.

3. An electrical connector, comprising:

a casing the interior of which is divided into two chambers by a partition, said casing being provided on its top with two passageways respectively communicating with said chambers and provided with two openings respectively communicating with said chambers;

two prongs respectively fixedly mounted into said two chambers in such a way that a lower part of each said prong extends out of said casing through one of said passageways, each said prong having first and second slots disposed at its upper part;

first and second pushbuttons respectively mounted in said chambers;

two insulator-fixing plates respectively mounted into said two chambers in such a way that each said insulator-fixing plate is supported at one end thereof by the first slot of each said prong and embedded at the other end thereof in a groove located in a surface of one of said pushbuttons movably mounted in and extending through said casing, each said insulator-fixing plate being surrounded by a first spring and having a toothed hole which allows a wire to pass through, said toothed hole being partially shielded by said first spring; and two bare wire-fixing plates respectively mounted into said two chambers in such a way that each said bare wire-fixing plate is supported at one end thereof by the second slot of said prong and embedded at the other end thereof in one of said pushbuttons movably mounted in and extending through said casing, each said bare wire-fixing plate being surrounded by a second spring and having a hole which only allows the bare portion of said wire to pass through, said hole being partially shielded by said second spring, depressing of said pushbuttons against spring bias allowing said wire to pass through associated holes in the bare wire-fixing plate and insulator-fixing plate.

* * * * *